US005718008A

United States Patent [19]

Pane

[11] Patent Number: 5,718,008

[45] Date of Patent: Feb. 17, 1998

[54] SHOWER BASE

[76] Inventor: Enrique Graells Pane, C. Casp 68, 08010 Barcelona, Spain

[21] Appl. No.: 748,650

[22] Filed: Nov. 14, 1996

[30] Foreign Application Priority Data

Nov. 17, 1995 [ES] Spain ..... 9502911
Jun. 18, 1996 [ES] Spain ..... 9601657

[51] Int. Cl.[6] ..... A47K 3/22

[52] U.S. Cl. ..... 4/613; 210/163

[58] Field of Search ..... 4/604, 612, 613; 210/163, 164

[56] References Cited

U.S. PATENT DOCUMENTS 4,777,675 10/1988 Letner ..... 4/613 X

FOREIGN PATENT DOCUMENTS 0492147 7/1992 European Pat. Off. .
1035381 4/1953 France ..... 4/613
4037795 6/1992 Germany .
2270836 3/1994 United Kingdom ..... 4/612

*Primary Examiner*—Charles E. Phillips
*Attorney, Agent, or Firm*—Steinberg, Raskin & Davidson, P.C.

[57] ABSTRACT

It is formed by a piece installed on the floor, constituted by a plate (1.101), whose top side is set at the same level as the floor (9) on which the plate is installed; along at least part of the perimeter of the plate, there is a header (4.102) which is open at the top and which does not rise higher than the top side of the plate; the bottom of the header is situated at a lower level than that of said top side of the plate; the header leads into a drainage orifice (7.104) also situated at a lower level with respect to that of said top side; it is characterized in that the header (4.102) presents a top opening (5.103) for the intake of water from the shower base, said opening being narrower than the header as such.

It facilitates the access of elderly and disabled people and of people on wheelchairs, and at the same time it can be efficiently cleaned.

6 Claims, 3 Drawing Sheets

SHOWER BASE

The present invention relates to a shower base which is notable in that it is situated at the same level as the floor, without any projection which can hinder access of the user. Furthermore, the shower base has, for the collection of water, at least one header leading into a drain.

BACKGROUND OF THE INVENTION

The shower bases currently known in the art have the shape of a tray, of greater or lesser depth, whose periphery forms a projection to prevent the water from flowing out of the tray.

As is obvious, access to a tray-shaped shower base which projects from the floor upon which it is installed is difficult for the elderly or for persons suffering from a physical or mental disability which prevents them from getting over obstacles such as steps or raised items projecting from the floor.

Known in the art are shower bases situated at the same level of the floor and provided with at least one peripheral water channel. Such a base is described in EP 0492147, claiming priority from DE 4037795 of 28.11.90. However, the shower base that is the subject of this patent has a channel for the intake of water that constitutes an obstacle on which disabled people or those on wheelchairs have to pass. On the other hand, reducing the overall width of the channel, and therefore of its open side, results in a reduction of the capacity thereof, and the channel is then insufficient to collect all the water from the shower when the latter is working with maximum flow.

Another drawback of the channel in shower bases placed at the same level as the floor is the difficulty to access easily the inner part thereof.

DESCRIPTION OF THE INVENTION

In order to solve the disadvantages outlined, the shower base of the invention has been designed; it presents no obstacle to hinder the access of any person and, at the same time, is provided with a drainage header having enough capacity and which can be cleaned efficiently.

The shower base is made up of a plate, whose top side is set at the same level as the floor on which the plate is installed. Along at least part of the perimeter of the plate there is a header which is open at the top and which does not rise higher than the top side of the plate, so that it does not form any projection which can hinder access to the shower plate. The bottom of the header is situated at a lower level than that of said top side of the plate. In its turn, the header leads into a drainage orifice also situated at a lower level with respect to that of said top side.

Preferably, the plate and the header form a single piece of ceramic, steel, resins or other material commonly used for the known shower bases, although it is possible for the base to be made up of more than one piece.

On the basis of the above cited known features, the shower base is characterized essentially in that the header presents a top opening for the intake of water from the shower base, said opening being narrower than the header as such.

The header is provided with a mouth having a shape suitable for the coupling of a source supplying a jet of clean water.

In one possible embodiment, the mouth is situated at the end of the top side of the header, opposite that leading into the drain.

Provision is also made for the mouth described to be constituted by an orifice formed in one of the side faces of the base, at the height of the header.

In a more specific version, the mouth described is formed by a widening of the top opening of the header, adapted so that the spray head of the shower can be coupled thereto.

Moreover, the top side of the base is provided with a step-like perimetric lowered section situated on a lower plane than that of the top side of the base, which constitutes a ledge for the fitting of a sealing gasket.

BRIEF DESCRIPTION OF THE DRAWINGS

For a better understanding of all that is described in the present specification some drawings are attached which, solely by way of example, show a practical case of embodiment of the shower base.

In said drawings.

DESCRIPTION OF PREFERRED EMBODIMENTS

Figure 1:
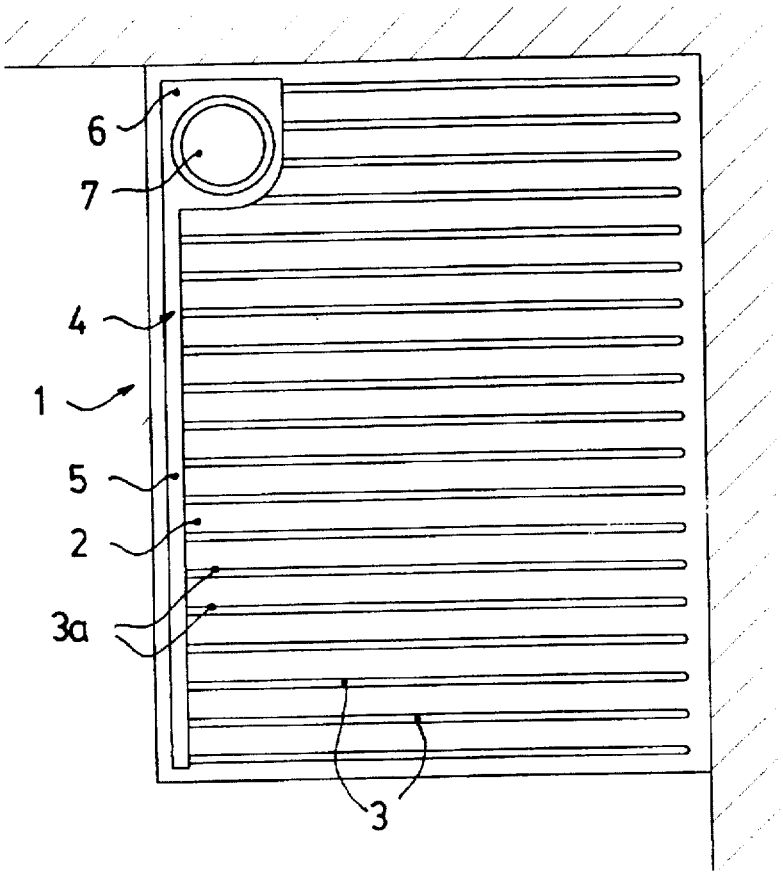
FIG. 1 is a plan view of the base installed in a corner of a bathroom, with its header lacking special cleaning means.
Figure 2:
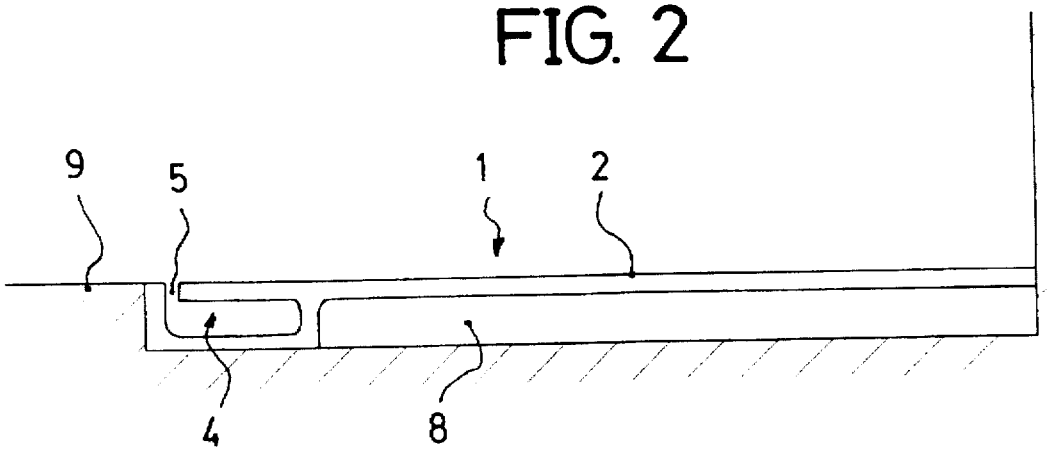
FIG. 2 is a view in cross-section of the base.
Figure 3:
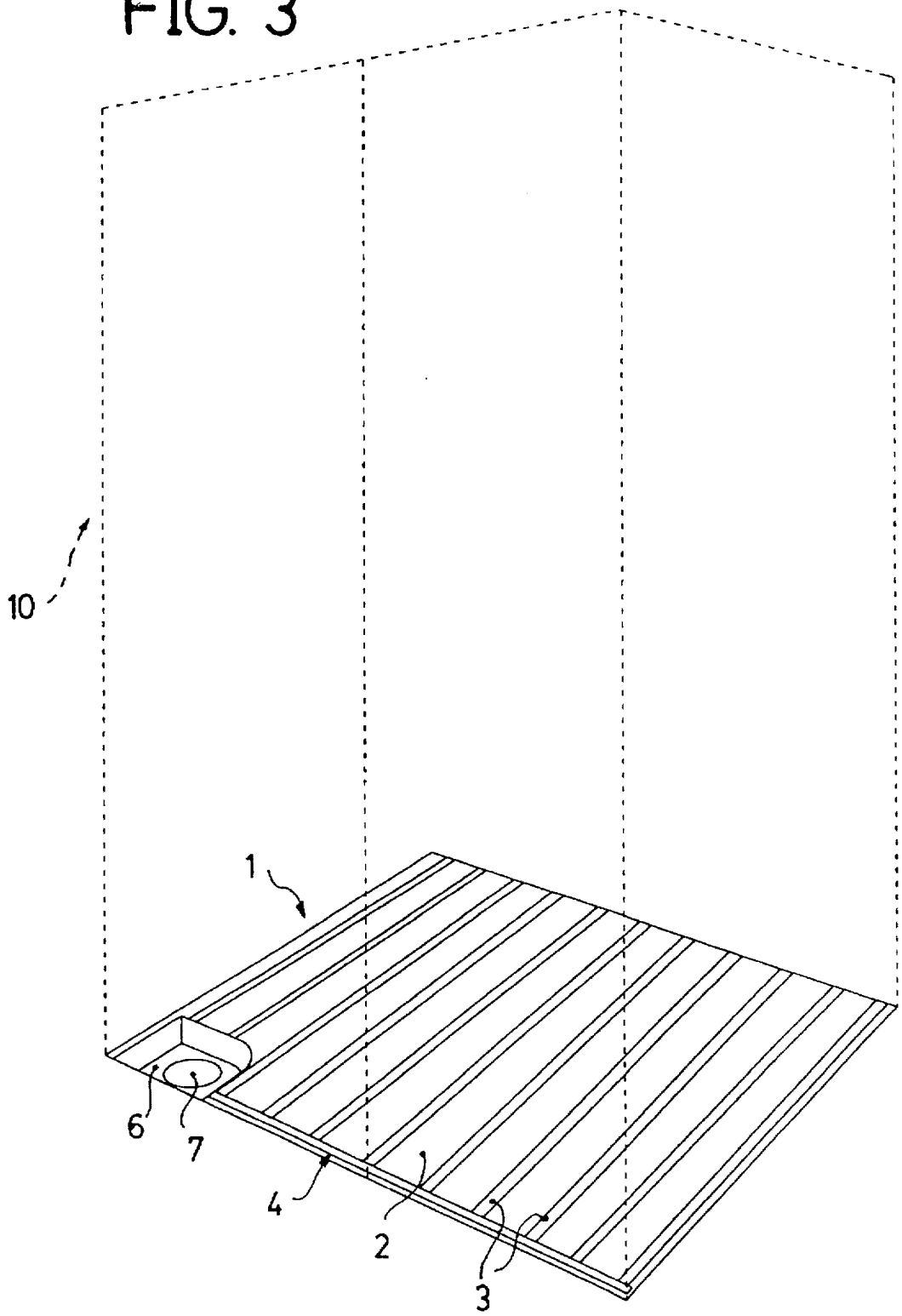
FIG. 3 is a perspective view of the base installed and protected by a conventional booth, shown in broken lines.

The shower base, of general reference 1 in the drawings, consists in FIGS. 1 to 3 of a plate 2 having its upper side provided with grooves or with a pattern 3 for drainage and non-slip function, one of whose ends 3*a* leads into a header of general reference 4, which forms a single body or piece with the plate 2. The top side of this header has a longitudinal opening 5 which is narrower than the header as such (FIG. 2). Said header runs along one of the sides of the plate 2 and leads into a hollow 6 situated at one corner of the base 1, with a drainage orifice 7.

The opening 5 is situated on the same plane as the top side of the plate 2.

The base 1 is installed in an inset or cavity 8 in a bathroom floor 9, so that the top side of the plate 2 is at the same level as the top of the floor, with no obstacle, whether projection or depression, to prevent access of a user to the base 1. It is of capital importance for the opening 5 of the header to be narrower than the header 4 itself, in order to avoid being an obstacle on which the user can trip and to avoid a decrease in the capacity of the header 4. For this reason, in addition to providing much greater aesthetic quality than that offered by the known bases which project from the floor level, the base object of the invention eliminates any barrier preventing access for the disabled or persons with difficulties in moving of their own accord.

The header 4 can be situated along one or more sides of the base, which base can have any outline with straight or curved sides. The presence of the header 4 prevents water from flowing out of the shower base.

The base 1 is of course surrounded by a cabinet 10 of known type, with an access door as is usual in this type of cabinet (FIG. 3).

Figure 4:
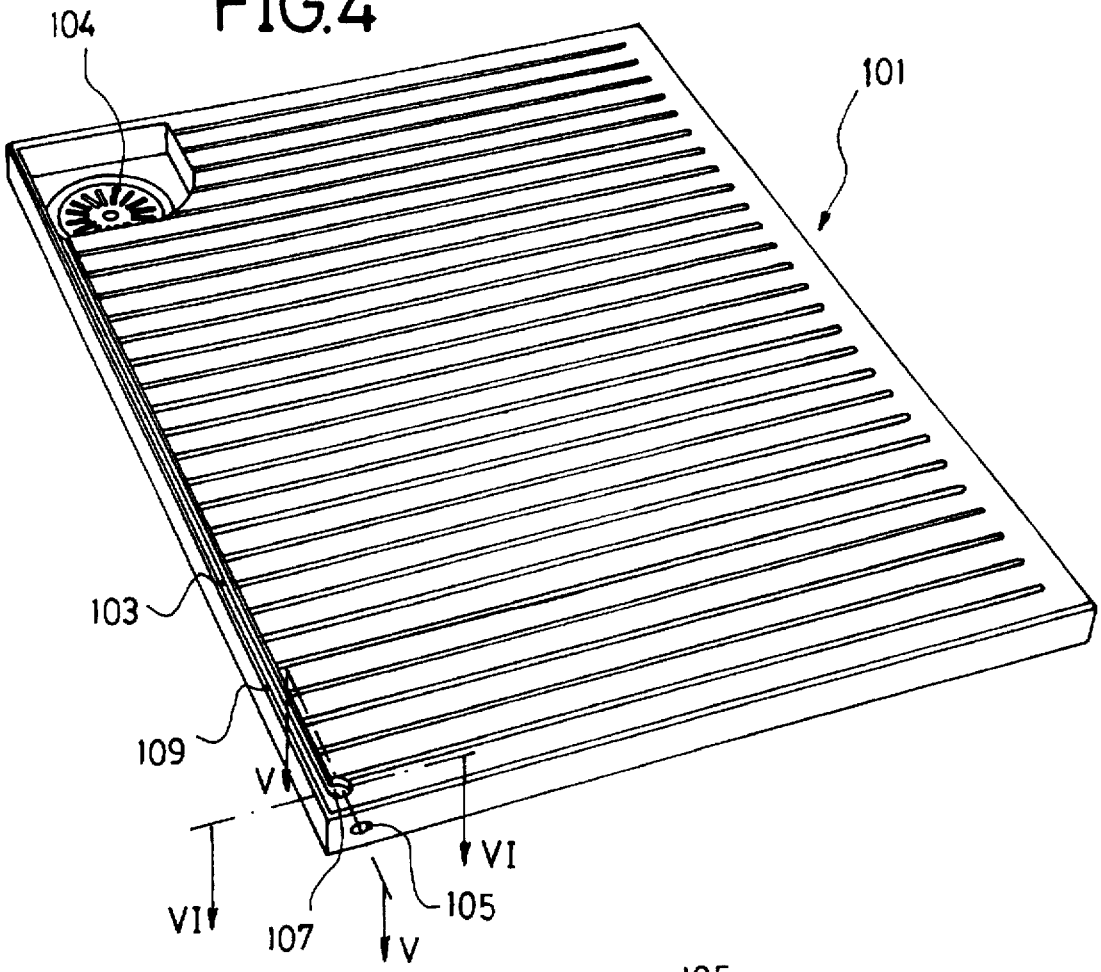
FIG. 4 is a perspective view of the shower base provided with special cleaning means.
Figure 5:
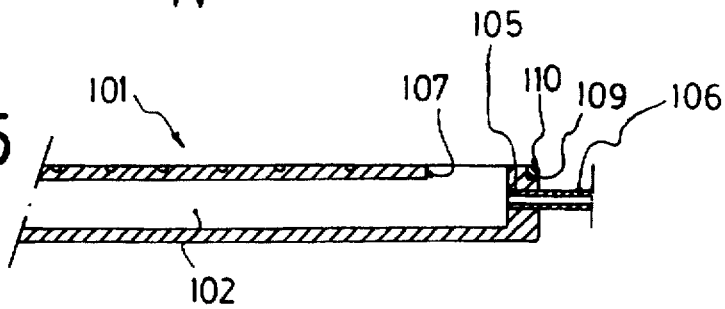
FIGS. 5 and 6 are two sections on a larger scale along planes V—V and VI—VI of FIG. 4.
Figure 6:
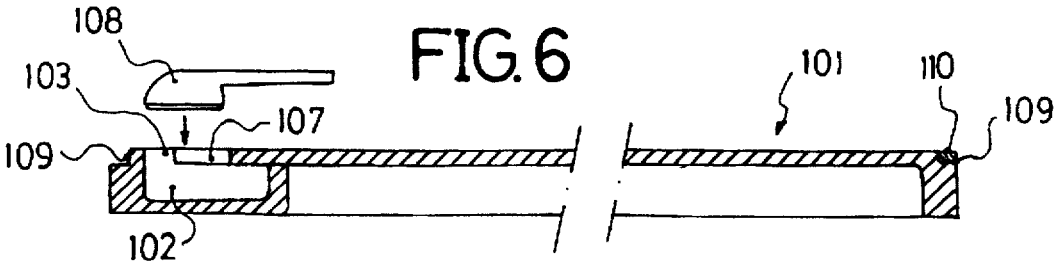

In the version of FIGS. 4 to 6, the shower base is formed, according to the example shown in the drawing, by a ceramic piece 101 or a piece of another material, provided at one of its ends with a header 102 having a narrow opening 103 situated on the top side of the plate. One end of this header leads into a drain 104 placed in a corner of the base. An orifice 105 formed in one of the side walls of the base opens at the opposite end of the header, said orifice being of appropriate shape for connection of a pipe 106 linked to the mains supply in order to provide a jet of clean water (FIG. 5).

It is also foreseen that the end of the opening 103 of the header 102 opposite the one which leads into the drain 104 may present a widened section or mouth 107 whose shape and dimensions are suitable for the connection of a spray head 108 of a hand-held shower head (FIG. 6).

In either of the two versions shown in FIGS. 4 to 6 it is possible to direct into the end of the header 102 opposite that which leads into the drain 104 a jet of water to allow easy and totally efficient cleaning of the bottom of the header.

The base has further been provided with a perimetric ledge or lowered section 109 on its top side, for the fitting of a sealing gasket 110.

It is possible to situate the opening or orifice for directing the jet of water into the header 102 at any point along same, and it would even be possible to provide a row of orifices along the header. A control cock could naturally be fitted to turn off the jet supply, where the latter comes from a pipe connected to the mains water supply.

The replacement of the channel for collecting the water from the shower with a header favours access to the shower base but makes cleaning more difficult. Cleaning has been promoted by providing orifices for the supply of a suitable water source, which is able to entrain the waste to the drain and allows the insertion of a bottle brush at one end and its withdrawal at the opposite end, allowing a most thorough cleaning to be performed. It has to be pointed out that all the corners have been eliminated in order to favour cleaning.

I claim:

1. A shower base, made up of a piece provided with drainage means, said shower base being constituted by a plate, having a top side which is set at the same level as a surrounding floor along at least part of the perimeter of the plate, and coinciding with an entrance or access to the shower base, said base having a header which is open at the top and which does not rise higher than the top side of the plate; the bottom of the header is situated at a lower level than that of said top side of the plate; said drainage means drains water into said header; the header leads into a drainage orifice also situated at a lower level with respect to that of said top side; said header presents a top opening for the intake of water from the shower base, said opening being narrower than a lateral dimension of said header.

2. A shower base as claimed in claim 1, characterized in that the header is provided with a mouth having a shape suitable for the coupling of a source or pipe supplying a jet of clean water.

3. A shower base as claimed in claim 1, characterized in that the mouth is situated at the end of the top side of the header, opposite that leading into the drain.

4. A shower base as claimed in claim 1, characterized in that the mouth is constituted by an orifice formed in one of the side faces of the base, at the height of the header.

5. A shower base as claimed in claim 1, characterized in that the mouth is formed by a widening of the top opening of the header, adapted so that the spray head of the shower can be coupled thereto.

6. A shower base as claimed in claim 1, characterized in that the top side is provided with a lowered section situated on a lower plane than that of the top side of the base, which constitutes a ledge for the fitting of a sealing gasket.

* * * * *